United States Patent [19]

Meyer

[11] Patent Number: 4,922,702

[45] Date of Patent: May 8, 1990

[54] STOPPING DEVICE FOR FIBER MATERIAL, SUCH AS A SILVER, ROVING OR SLUBBING IN A TEXTILE MACHINE AND ENERGY STORAGE DEVICE

[75] Inventor: Urs Meyer, Niederglatt, Switzerland

[73] Assignee: Maschinenfabrik Rieter AG, Winterthur, Switzerland

[21] Appl. No.: 288,267

[22] Filed: Dec. 22, 1988

[51] Int. Cl.[5] ..... D01H 13/18

[52] U.S. Cl. ..... 57/87; 19/0.25

[58] Field of Search ..... 57/80, 81, 83, 87; 19/0.2, 0.22, 0.25

[56] References Cited

U.S. PATENT DOCUMENTS

| | | | |
|---|---|---|---|
| 4,570,429 | 2/1986 | Güttler et al. | 57/87 X |
| 4,581,881 | 4/1986 | Lamb | 57/87 |
| 4,683,712 | 8/1987 | Peters | 57/81 |
| 4,727,713 | 3/1988 | König et al. | 57/87 X |

FOREIGN PATENT DOCUMENTS

| | | |
|---|---|---|
| 0036066 | 9/1981 | European Pat. Off. . |
| 0210636 | 2/1987 | European Pat. Off. . |
| 0292326 | 11/1914 | Fed. Rep. of Germany . |
| 2153136 | 5/1972 | Fed. Rep. of Germany . |
| 2832753 | 2/1979 | Fed. Rep. of Germany . |
| 3100049 | 8/1982 | Fed. Rep. of Germany . |
| 3123476 | 12/1982 | Fed. Rep. of Germany . |
| 3126141 | 1/1983 | Fed. Rep. of Germany . |
| 3218660 | 8/1983 | Fed. Rep. of Germany . |
| 3506013 | 9/1985 | Fed. Rep. of Germany . |
| 3526305 | 1/1987 | Fed. Rep. of Germany . |
| 3526309 | 1/1987 | Fed. Rep. of Germany . |
| 3606609 | 9/1987 | Fed. Rep. of Germany . |
| 1196437 | 12/1985 | U.S.S.R. . |
| 1208103 | 1/1986 | U.S.S.R. . |
| 1139901 | 1/1969 | United Kingdom . |

*Primary Examiner*—Joseph J. Hail, III

*Attorney, Agent, or Firm*—Werner W. Kleeman

[57] ABSTRACT

The slubbing stopping device comprises a movable part having a magnet and a fixed part having a magnet. One of these magnets is an electromagnet and the other a permanent magnet. The movable and fixed parts can assume an operating position in readiness for clamping the elongate or rope-like fiber material which may be constituted by a silver, roving or slubbing or the like. These movable and fixed parts, when in the operating position, are connected by the magnetic field of the permanent magnet. An electrical energy supply delivers electrical energy to the electromagnet so that the movable and fixed parts can be separated from one another and the movable part assumes a slubbing clamping position. The electrical energy supply powers the electromagnet such that the permanent magnet and the electromagnet, which previously adhered to one another by magnetic attraction, are repelled so as to separate the permanent magnet and electromagnet from one another.

12 Claims, 4 Drawing Sheets

STOPPING DEVICE FOR FIBER MATERIAL, SUCH AS A SILVER, ROVING OR SLUBBING IN A TEXTILE MACHINE AND ENERGY STORAGE DEVICE

CROSS REFERENCE TO RELATED CASE

This application is related to the commonly assigned, co-pending United States application Ser. No. 07/288,179, filed Dec. 22, 1988, entitled "METHOD OF, AND APPARATUS FOR, TRANSMITTING DATA IN A MANUFACTURING MACHINE COMPRISING A PLURALITY OF PRODUCTION STATIONS".

BACKGROUND OF THE INVENTION

The present invention relates to a new and improved construction of a stopping device for fiber material, particularly elongate or rope-like fiber material such as a sliver, roving or slubbing in a textile machine, more particularly a spinning machine. Such stopping device thus will be generally referred to hereinafter broadly as a slubbing stopping device whether the fiber material be a sliver, roving or slubbing or the like. The present invention also relates to an improved energy storage device, particularly for use with the slubbing stopping device.

U.S. Pat. No. 4,683,712, granted Aug. 4, 1987 and the cognate German Patent Publication No. 3,526,309, published Jan. 29, 1987 may be cited as one of the many examples of a stopping device for a sliver, typically referred to as a slubbing stopping device in the case of a ring spinning machine. In the therein disclosed slubbing stopping device a compression spring is held in its stressed or loaded position by a latch, the latter being unlatched by an electromagnet so that the spring presses a movable clamping element upwards against a stationary clamping surface in order to clamp the slubbing. It will be apparent that such an electromagnet requires a high current strength in order to overcome the latching forces. In order to avoid overloading the energy source in the event there are used a plurality of slubbing stopping devices which are simultaneously triggered, a capacitor is proposed as an energy storage device for each slubbing stopping device in the aforementioned prior art system. However, a considerable outlay is necessary in terms of the electrical circuitry for the charging and storage circuit.

In U.S. Pat. No. 4,727,713, granted Mar. 1, 1988 and the cognate German Patent Publication No. 3,606,609, published Sept. 3, 1987, the object of which is to ensure certain triggering of the slubbing stopping device when necessary, as a result of the electromagnetic triggering operation the slubbing is clamped against a non-driven preliminary drafting roller of a drafting arrangement. For triggering purposes, a stationary electromagnet surrounds a movable permanent magnet and so attenuates the holding force or retentivity of the permanent magnet that the permanent magnet can no longer produce the required holding action. In other words, the magnetic field of the permanent magnet is attenuated in the direction of polarity reversal. The permanent magnet must continually overcome the tension or loading force of a spring which is intended to displace an actuating rod and thus a clamp segment, so that this permanent magnet has to be made relatively large. The coil enclosing the permanent magnet is even more voluminous or bulky, so that for cost reasons alone a triggering device or system of this kind cannot be considered for practical use. The subsequent publication "Zinser Novum 8" gives an indication of how difficult it really is to attain a practical embodiment of this allegedly certain triggering system, this publication describing a quite conventional actuation of a slubbing stopping device by means of a solenoid and a pull rod released thereby.

SUMMARY OF THE INVENTION

Therefore with the foregoing in mind it is a primary object of the present invention to provide a new and improved construction of a slubbing stopping device for elongate or rope-like fiber material, such as a sliver, roving or slubbing in a textile machine, which does not suffer from the aforementioned drawbacks and shortcomings of the prior art constructions.

A further important and more specific object of the present invention proposes a slubbing stopping device of the character described which can be triggered by an extremely low current intensity or strength and which ensures small magnet dimensions.

In keeping with the immediately preceding object it is a further important object of the present invention to considerably reduce the outlay in terms of the electrical circuitry needed for the operation of the slubbing stopping device.

Another significant object of the present invention is directed to an improved construction of slubbing stopping device which relies upon magnetic repulsion for the triggering of the slubbing stopping device.

A further noteworthy object of the present invention is directed to an improved construction of slubbing stopping device which can exploit gravitional forces for clamping of the sliver, roving, slubbing or the like.

Now in order to implement these and still further objects of the present invention, which will become more readily apparent as the description proceeds, the slubbing stopping device of the present development is of the type comprising a movable part having a magnet and a fixed part having a magnet. One of these magnets is an electromagnet and the other magnet is a permanent magnet. The movable and fixed parts can assume an operative or operating position in readiness for stopping or clamping the "slubbing", meaning the elongate or rope-like fiber material which may be constituted by a sliver, roving or slubbing or the like. These movable and fixed parts when in the operative or operating position are connected by the magnetic field of the permanent magnet causing such fixed and movable parts to magnetically adhere to one another. Means serve for supplying electrical energy to the electromagnet so that the movable and fixed parts can be disconnected or separated from one another such that the movable part assumes a slubbing clamping position. The electrical energy supplying means powers the electromagnet such that the permanent magnet and the electromagnet, which previously adhered to one another by magnetic attraction, are now repelled so as to separate or disconnect the permanent magnet and electromagnet from one another.

A typical effective value for the energy required to trigger just one latching or locking operation when using solenoids of a stopping device is in the order of 0.2 Ws (watt seconds). On the basis of the principles applied to fault current circuit breakers, the permanent magnet of the stopping device according to the present invention does not have its polarity reversed, or its magnetic field attenuated, but instead is repelled with an intact magnetic field and there is no displacement or shifting of iron cores in the electromagnet. Measurements have shown that energy in an amount less than 0.02 Ws is sufficient for the desired magnetic repulsion. The electromagnet can be correspondingly reduced in size. As a result of the reduction of the current consumption of the individual slubbing stopping devices it is now possible to power all of the slubbing stopping devices directly from a single power supply or feed line without any risk of overloading the energy source and without the use of capacitors for each spinning location. In the event of simultaneous triggering of 1000 slubbing stopping devices, 10 amperes is required with a power supply or feed voltage of about 48 volts. Nor are there required any special time-delay devices for the timewise staggered triggering operation, for example, as described in the aforementioned U.S. Pat. No. 4,683,712 and the cognate German Patent No. 3,526,309, so that the outlay or expenditure in terms of electrical circuitry is very small.

It is possible to construct the slubbing stopping device such that the movable part comprises a pivotably mounted lever or lever member provided with a first arm carrying the permanent magnet. This movable part, following the aforenoted magnetic repulsion, assumes the slubbing stopping or clamping position under the action of the force of gravity. Since the permanent magnet only has to hold or retain the weight of the movable part, the entire magnet system can be kept small. Since clamping of the slubbing is effected by gravity, no spring is necessary for this purpose.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various figures of the drawings, there have been generally used the same reference characters to denote the same or analogous components and wherein.

DETAILED DESCRIPTION OF THE PREFERRED EMBODIMENTS

Describing now the drawings, it is to be understood that to simplify the showing thereof, only enough of the construction of the exemplary embodiments of stopping device for typically elongate or rope-like fiber material, such as a sliver, roving or slubbing in a textile machine, such as a ring spinning machine has been illustrated therein as is needed to enable one skilled in the art to readily understand the underlying principles and concepts of this invention. It also will be recalled that irrespective of the nature of the elongate or rope-like fiber material which is acted upon by the stopping device such has been generally broadly conveniently termed a slubbing stopping device.

Figure 1:
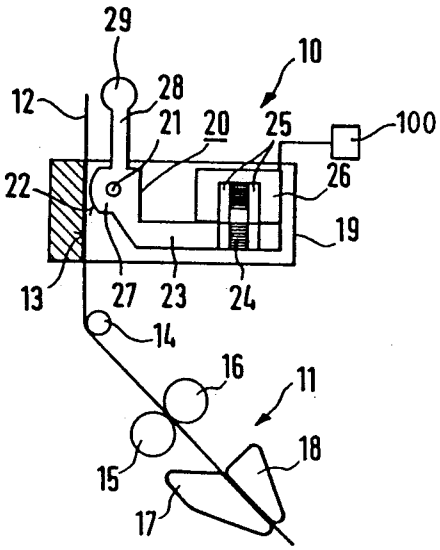
FIG. 1 is a schematic illustration of a slubbing stopping device in the operative or operating position.

Turning attention now specifically to FIG. 1, there is depicted therein a slubbing stopping device 10 disposed upstream or ahead of a drafting arrangement or device 11. The slubbing stopping device 10 and the drafting arrangement 11 belong to a spinning location or station of a suitable ring spinning machine (not shown) or another suitable spinning machine equipped with spinning locations or stations fed with fiber material via a related drafting arrangement, for instance, a flyer or a false-twist spinning machine. The fiber material, here referred to broadly as a slubbing 12, which as previously explained may be a sliver, roving or slubbing or the like, coming from, for instance, a roving bobbin or a can (not shown) via corresponding guides (also not shown), slides over a stationary guide surface 13 of the slubbing stopping device 10 and is deflected at a guide roller 14 before entering the drafting arrangement 11. The slubbing 12 is conveyed or forwarded by virtue of the rotation of the preliminary or inlet drafting rollers 15 and 16 of the drafting arrangement 11. The slubbing 12 is then subjected to further drafting by the rotating aprons 17 and 18 located in the main drafting zone of the drafting arrangement 11 and then appropriately spun into a yarn, as is well known in this technology.

The slubbing stopping device 10 has a stationary or fixed part or member, here a carrier or support 19 on which a movable part or member, here a clamping lever or lever member 20 is pivotally mounted by means of a suitable pivot or pivot means 21. In the operative or operating position depicted in FIG. 1, the slubbing 12 runs or travels between the stationary guide surface 13 and a clamping surface 22 of the pivotably mounted clamping lever 20. In this operating position the clamping surface 22 is spaced from the stationary guide surface 13 so that the movement of the slubbing 12 between these two surfaces 13 and 22 is not adversely affected.

Figure 2:
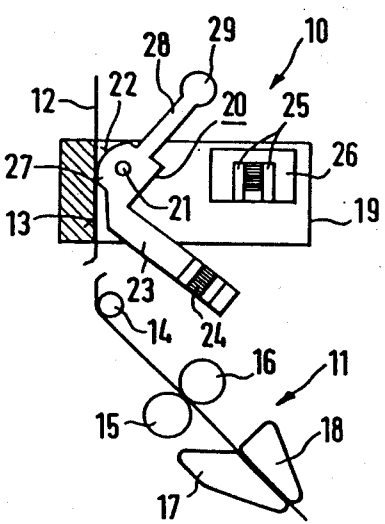
FIG. 2 schematically illustrates the slubbing stopping device of FIG. 1 in the slubbing clamping position.

The pivotably mounted clamping lever 20 is provided with three arms or arm members 23, 27 and 28. More specifically, there is provided a first arm 23 which extends substantially horizontally in the aforedescribed operating position and which adheres, by means of the magnetic field and thus magnetic attraction exerted by a permanent magnet 24 disposed thereon, to a magnetizable yoke part 25' of an electromagnet 26 secured to the stationary or fixed carrier or support 19. There is further provided a second arm 27 which is located remote from the first arm 23 and which is provided with the clamping surface 22. Finally, there is provided a third upwardly directed or extending arm 28 which can carry a signal flag 29 or equivalent signalling structure. In the operating position, the signal flag 29 is preferably concealed from the machine operator (whether human or an automatic robot) by other structural parts (not shown). After the slubbing stopping device 10 has been triggered or activated, in other words, after separation or disconnection of the magnets 24 and 26 from one another the clamping lever 20 drops into the clamping position shown in FIG. 2 in response to the action of gravity. In this clamping position, where the slubbing 12 is stopped or ruptured, the slubbing 12 is clamped between the stationary guide surface 13 and the clamping surface 22 and tears because of the tension exerted by the preliminary or inlet draft rollers 15 and 16. In the clamping position the signal flag 29 pivots forwards into a position in which it can be readily observed by the operator or by a robot to indicate a fault condition.

The clamping force exerted on the slubbing 12 is variable by appropriate choice of the material from which there is fabricated the pivotably mounted lever 20 and hence there can be selected the weight of such lever 20, by the mass distribution within the lever 20 (position of the center of gravity with respect to the pivot or pivot means 21) and the range of movement of the lever 20 (length of the arm 23, angular range) between the operating position and the clamping position.

Figure 5:
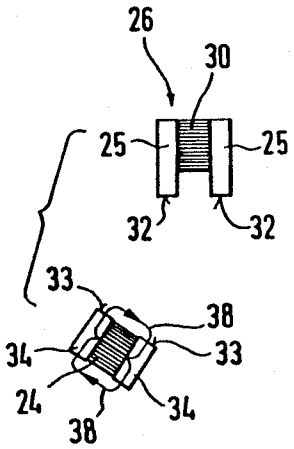
FIG. 5 schematically illustrates the permanent magnet and the electromagnet of FIGS. 3 and 4 after separation from one another.
Figure 4:
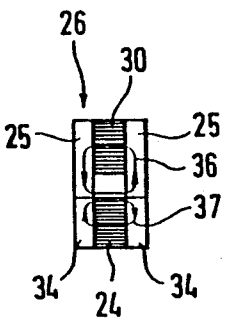
FIG. 4 schematically illustrates the coaction between the permanent magnet and the electromagnet of the slubbing stopping device of FIG. 1 at the start of separation or magnetic repulsion of such magnets.
Figure 3:
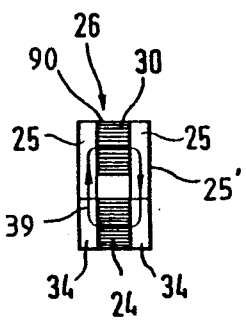
FIG. 3 schematically illustrates the coaction between the permanent magnet and the electromagnet when the slubbing stopping device of FIG. 1 is in the operating position.

The magnet system comprising the magnets 24 and 26 is shown in FIGS. 3, 4 and 5. The magnetic lines of flux of the permanent magnet 24 in the operating position extend solely through a magnetic circuit formed from soft iron or similar high-permeability material, so that even with a very small permanent magnet and a correspondingly small electromagnet it is possible to produce a strong holding or retention force. The electromagnet 26, which is mounted on the stationary or fixed part defined by the carrier or support 19, comprises a substantially C-shaped soft-iron core 90 around which a coil or winding 30 is wound. The core 90 is connected on both sides to two magnetizable legs or limbs 25 forming the yoke part 25'. The two legs or limbs 25 have respective end faces or surfaces 32 (see FIG. 5) to which, in the operating position shown in FIG. 3, all end faces 33 of two pole pieces 34 of the permanent magnet 24 adhere by magnetic attraction solely because of the magnetization produced by the permanent magnet 24, since the coil or winding 30 does not yet carry any current. The magnetic flux lines of the permanent magnet 24, in this operating position in which the electromagnet 26 is not yet energized, are shown diagrammatically by path 39 in FIG. 3. Here, for example, the left-hand pole piece 34 forms a north pole and the right-hand pole piece 34 a south pole and the magnetic flux lines pass only through iron parts, so that the holding or retention force is relatively high.

FIG. 4 shows the same magnet system but subject to a current flowing through the coil or winding 30 of the electromagnet 26. To that end, the electromagnet 26 can be appropriately powered by any suitable electrical energy or power supply or source 100 as shown in FIG. 1. This current or current flow, in turn, generates a magnetic field, as indicated by the path 36, which is so related or correlated to the magnetic field of the permanent magnet 24 that the legs or limbs 25 of the electromagnet 26 have the same polarity as the confronting pole pieces 34 of the permanent magnet 24. The flux lines of the permanent magnet 24 are displaced from path 39 to path 37. The separating end faces or surfaces 33 and 32 (see FIG. 5) are accordingly no longer penetrated by magnetic flux lines, the retention or holding force originating from the permanent magnet 24 disappears and the coacting magnets 24 and 26 separate or disconnect from one another both in response to gravity and the repelling force or mutual repulsion of the confronting separating end faces or surfaces 32 and 33 which possess the same magnetic polarity.

FIG. 5 shows the magnets 24 and 26 in the dropped or separated position which is realized by virtue of the magnetic repulsion. The distance between the pole pieces 34 and the legs or limbs 25 is such that the magnetic flux lines of the permanent magnet 24 now flow partially through air, as shown by path 38. Consequently, no magnetic retention or holding force can be generated between the core 90 of the electromagnet 26 and the permanent magnet 24. The magnet system thus has no current flowing in coil or winding 30 in the dropped clamping position depicted in FIG. 5. There is therefore no need to maintain the current flow in the coil or winding 30. Closing of the magnet system, i.e. restoration of the previously discussed adhesion or magnetic attraction of the magnets 24 and 26 must be produced by an external force, for example, by an operator or a robot, to reduce the distance between the core of the electromagnet 26 and the permanent magnet 24. In these conditions the coil 30 should be kept devoid of current (or possibly appropriately energized so as to attract the permanent magnet). As soon as the moving part, i.e. the clamping lever 20, again bears against the electromagnet 26 in the closed or operating position, the configuration of the flux lines shown in FIG. 3 is restored and the magnetic retention or holding force between the magnets 24 and 26 is again fully present.

Figure 6:
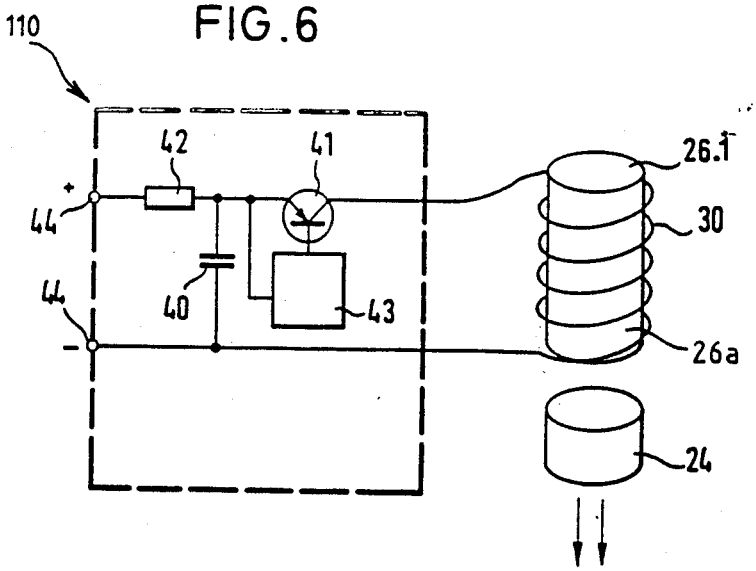
FIG. 6 is a schematic block circuit diagram of another embodiment of the electromagnetic part of the slubbing stopping device shown in FIGS. 1 and 2, and specifically depicting an energy storage and supply circuit for the slubbing stopping device.

If it is necessary to relieve the energy source or supply of load or to reduce the power supply or feed voltage, for instance, to 24 volts, then a suitable energy storage and supply arrangement 110 for this purpose has been depicted by way of example in FIG. 6. This energy storage and supply arrangement 110 basically comprises a capacitor 40, a switchable element 41, for instance, a transistor, a charging resistor 42, and a control circuit 43. The permanent magnet 24 adheres by magnetic attraction to the core **26*a* of the electromagnet 26.1 in response to its own magnetic field when the slubbing stopping device, such as the slubbing stopping device 10 of FIG. 1, is in the operating or operative position. The capacitor 40 is charged by a suitable current or energy source 44 via the charging resistor 42 and now stores a certain amount of energy, approximately 0.02 Ws. At this time the switching element or transistor 41 is cut off or rendered non-conducting by the control circuit 43. If a conventional yarn or thread stop motion associated with this particular spinning location or station detects a yarn or thread break, then in a manner well known in this technology the control circuit 43 receives a signal and delivers a current pulse to the transistor 41 which renders it conductive. The capacitor 40 then discharges via the transistor 41 and through the coil or winding 30. The associated short current pulse or current flow generates in this coil or winding 30 a magnetic field which acts in opposition to the field of the permanent magnet 24. As already described, the permanent magnet 24 is then magnetically repelled by the core 26*a* of the electromagnet 26.1 and thus causes the slubbing stopping device to close and assume the slubbing clamping position previously discussed. Since the current consumption of the electromagnet 26 can be kept small, the capacitor 40 can also be made small. A charging capacity or power of about 0.03 W is enough to charge up the capacitor 40** in a sufficiently short time.

Figure 7:
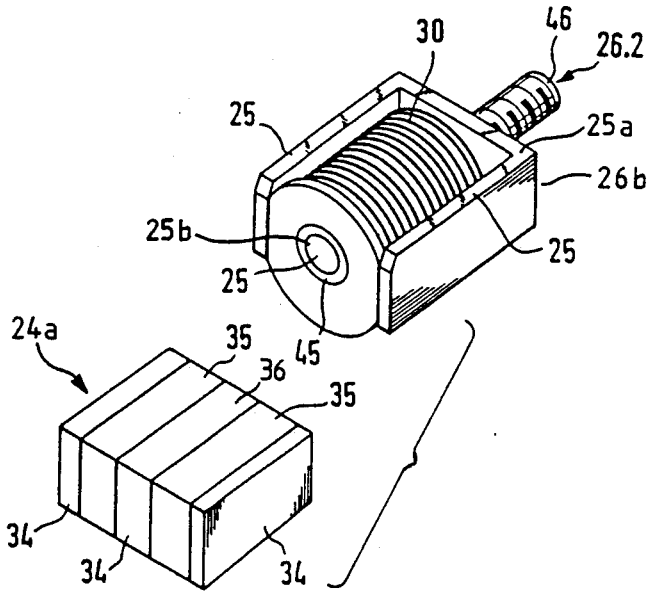
FIG. 7 is a perspective view of another variant embodiment of the electromagnetic part of the slubbing stopping device shown in FIGS. 1 and 2.

FIG. 7 shows another variant embodiment of the magnet system in which the electromagnet 26.2 has a substantially E-shaped core **26*b* with three legs or limbs 25 interconnected by a web 25*a*. The coil or winding 30 of the electromagnet 26.2 which is disposed on a coil carrier or support 45, extends around the middle leg or limb 25*b*. The holding or retention magnet 24*a* comprises three soft-iron pole pieces 34 and two permanent magnets or permanent magnet elements 35 each disposed on one side of the intermediate or middle pole piece 36, the polarity of the two permanent magnets 35 being opposed or opposite to one another. A screw or threaded member 46 projects from the web or web member 25*a* of the substantially E-shaped core in a direction opposed to the middle leg or limb 25*b*. The middle pole piece 36 is advantageously made wider than the two outer poles pieces 34 to ensure that no magnetic saturation occurs in the middle pole piece 36. It has been found that a thin metal plate or washer (not shown) of aluminum or some other non-magnetic or diamagnetic material advantageously can be used between the poles of the or each permanent magnet 24*a* and the legs or limbs 25 of the core 26*b* of the electromagnet 26.2**. These thin plates or washers make the arrangement less tolerance-sensitive.

Figure 8:
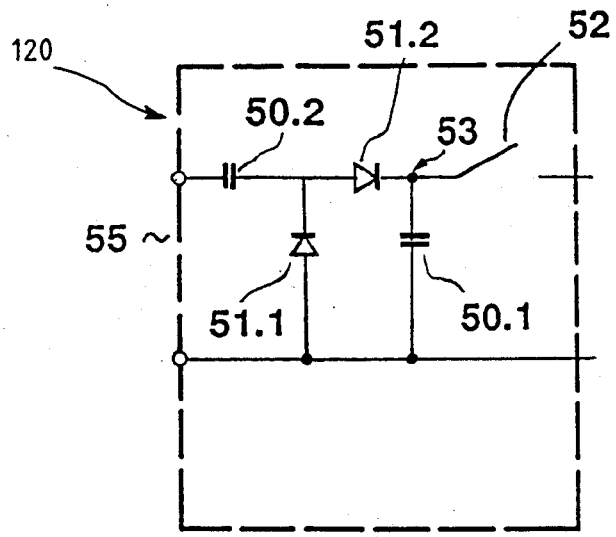
FIG. 8 is a schematic block circuit diagram of a modification of the energy storage and supply circuit depicted in FIG. 6.

FIG. 8 shows another possibility of an energy storage and supply arrangement 120. This energy storage and supply arrangement 120 is a single-stage voltage doubler cascade connected to an a.c. voltage source or energy source 55 having the effective voltage Ueff. If the a.c. voltage is negative, the diode 51.1 conducts and the capacitor 50.2 is charged up to the peak voltage of the a.c. voltage source 55 (2 ½ times Ueff). During the positive half wave of the a.c. voltage source 55, the diode 51.1 cuts off and the peak voltage of the a.c. voltage source 55 and the voltage appearing at the capacitor 50.1 are added at the junction 53. When the switch 52 is open, the capacitor 50.1 is gradually charged to a voltage which amounts to 2 times 2 ½ times Ueff.

The capacitor 50.1 performs a function corresponding to that of the capacitor 40 (FIG. 6), the switch 52 in FIG. 8 corresponding to the transistor 41 in FIG. 6. Accordingly, the capacitor 50.1 discharges through the electromagnetic coil (not shown) as soon as the switch 52 is closed.

For the same input voltage a considerably greater amount of energy can be stored in capacitor 50.1 than in the capacitor 40 used in the circuit arrangement shown in FIG. 6, or else a smaller capacitor is required for the same amount of energy. By using an a.c. voltage source the charging current is automatically limited in the case of uncharged capacitors, and the resistor 42 which is used for limiting the charging current in the circuit arrangement of FIG. 6 and which is subject to energy losses, therefore can be dispensed with.

The slubbing stopping device according to the present invention can be used in cases in which an elongate or rope-like fiber structure (roving from a flyer, sliver from a card or drawing device) has to be fed and, if necessary, suddenly stopped. However, it is particularly useful in cases where a large number of spinning locations or stations have to be disposed side by side and each has to be equipped with its own slubbing stopping device.

While there are shown and described present preferred embodiments of the invention, it is to be distinctly understood that the invention is not limited thereto, but may be otherwise variously embodied and practiced within the scope of the following claims.

What I claim is:

1. A stopping device for elongate fiber material in a textile machine, comprising:

a movable part having a magnet;

a stationary part having a magnet;

one of said magnets being an electromagnet;

the other of said magnets being a permanent magnet having a magnetic field;

said movable part and said stationary part being capable of assuming an operating position with respect to one another;

said movable part and said stationary part when in the operating position being connected with one another by the magnetic field of the permanent magnet;

said magnetic field of the permanent magnet causing magnetic attraction of the permanent magnet at the electromagnet;

guide means cooperating with the elongate fiber material;

said movable part including clamping means cooperating with said guide means for clamping the elongate fiber material when said movable part assumes a clamping position;

means for supplying electrical energy to said electromagnet for separating said movable part and said stationary part from one another such that said movable part assumes the clamping position for the elongate fiber material; and said means for supplying electrical energy to said electromagnet causing separation of said electromagnet and said permanent magnet adhering to one another by magnetic attraction, by magnetic repulsion of the permanent magnet and electromagnet with respect to one another.

2. The stopping device as defined in claim 1, wherein:

said clamping means of said movable part comprises a clamping lever;

means for pivotably mounting said clamping lever;

said pivotably mounted clamping lever having a first arm provided with the permanent magnet; and said movable part, following magnetic repulsion of the permanent magnet from the electromagnet, assuming said clamping position in response to the action of gravity.

3. The stopping device as defined in claim 2, wherein:

said guide means comprises a stationary guide surface serving for clamping the elongate fiber material; and said pivotably mounted clamping lever comprises a second arm provided with a clamping surface which cooperates with said stationary guide surface for clamping the elongate fiber material when the movable part assumes said clamping position.

4. The stopping device as defined in claim 3, wherein:

said pivotably mounted clamping lever has a third arm provided with signal flag means.

5. The stoppng device as defined in claim 2, wherein:

said pivotably mounted clamping lever has a center of gravity located at a predetermined position with respect to said pivotably mounting means and said first arm of said clamping lever has a predetermined length in relation to said pivotably mounting means such that a predetermined clamping force is exerted on the elognate fiber material by the clamping means of said movable part.

6. The stopping device as defined in claim 1, wherein:

said electromagnet comprises core means and magnetizable legs on opposite sides of said core means;

each leg having an end face;

said permanent magnet comprises two pole pieces each having an end face; and said end faces of said magnetizable legs and said end faces of said pole pieces adhering to one another by magnetic attraction in said operative position.

7. The stopping device as defined in claim 1, wherein:

said electromagnet has a substantially E-shaped core comprising three legs connected by a web;

one of said three legs defining a middle leg;

said electromagnet comprising a coil engaging said middle leg;

said permanent magnet comprising three soft-iron pole pieces including a middle pole piece and two permanent magnet elements each disposed on one side of the middle pole piece; and the magnetic polarity of the two permanent magnet elements being opposed to one another.

8. The stopping device as defined in claim 7, wherein:

said middle pole piece has a predeterminate width;

the other two of said three soft-iron pole pieces defining outer pole pieces;

each of said outer pole pieces having a predeterminate width; and said predeterminate width of said middle pole piece being greater than said predeterminate width of each of said outer pole pieces.

9. The stopping device as defined in claim 7, further including:

screw means for securing the electromagnet; and said screw means projecting from said web of said substantially E-shaped core in a direction opposite to said middle leg.

10. The stopping device as defined in claim 1, wherein:

said electromagnet includes an iron portion; and said permanent magnet having a magnetic field which is closed through the iron portion of the electromagnet when said movable part assumes said operating position.

11. The stopping device as defined in claim 1, wherein:

said permanent magnet having a magnetic field which is closed within the permanent magnet itself when the movable part and the stationary part are separated from one another and the movable part assumes the clamping position.

12. The stopping device as defined in claim 1, wherein:

said electromagnet has a core; and said movable part and said stationary part, following magnetic repulsion of the permanent magnet and the electromagnet with respect to one another, being spaced from one another at a distance such that said magnetic attraction of the permanent magnet at the electromagnet is first possible by application of an external force to reduce the distance between the core of the electromagnet and the permanent magnet in order to establish said magnetic attraction of the permanent magnet at the electromagnet.

* * * * *